US006045061A

United States Patent [19]

Hüttlin

[11] Patent Number: 6,045,061

[45] Date of Patent: Apr. 4, 2000

[54] DIFFUSING NOZZLE

[76] Inventor: Herbert Hüttlin, Wiesentalstrasse 74 A, 79539 Lörrach, Germany

[21] Appl. No.: 09/183,533

[22] Filed: Oct. 30, 1998

[30] Foreign Application Priority Data

Nov. 6, 1997 [DE] Germany ..... 197 49 072

[51] Int. Cl.[7] ..... B05B 7/06

[52] U.S. Cl. ..... 239/424; 239/423

[58] Field of Search ..... 239/423, 424, 239/424.5, 428

[56] References Cited

U.S. PATENT DOCUMENTS 1,713,529 5/1929 Chandler ..... 239/424 X
3,084,874 4/1963 Jones et al. ..... 239/424 X
3,770,207 11/1973 Muller et al. ..... 239/424 X
4,544,095 10/1985 Lutzen ..... 239/424 X
5,845,846 12/1998 Watanabe et al. ..... 239/424 X

*Primary Examiner*—Lesley D. Morris
*Attorney, Agent, or Firm*—Harness, Dickey & Pierce, P.L.C.

[57] ABSTRACT

A multi-substance diffusing nozzle having at least three concentric flow channels each leading to a gap-like discharge opening, a discharge gap for atomizing a liquid being surrounded on either side by a discharge gap for passing out a gas, is configured such that the gap width of the discharge gap for atomizing the liquid at the discharge opening is in the range from 0.2 mm to 2.2 mm; that the gap width of the discharge gaps for passing out the gases at the discharge opening is in each case in the range from 0.3 mm to 2.3 mm; and that the ratio between the gap width of the discharge gap for atomizing the liquid and its circumferential gap length is in the range from 1:50 to 1:5000 (FIG. 2).

14 Claims, 4 Drawing Sheets

DIFFUSING NOZZLE

The invention relates to a multi-substance diffusing nozzle having at least three concentric flow channels each leading to a gap-like discharge opening, a discharge gap for atomizing a liquid being surrounded on either side by a respective discharge gap for passing out a gas.

A diffusing nozzle of this kind is known from German Patent No. 857 924.

In this diffusing nozzle, annular flow channels are provided which are constituted by multiple tubes inserted concentrically into one another. The flow channels taper radially inward in the area of the discharge opening.

A flow channel for atomizing a liquid is surrounded on either side by channels for the passage of air.

A common application for a multi-substance diffusing nozzle according to the present application is that of treating a particulate material with the liquid that is to be atomized.

A treatment operation consists, for example, in pelletizing a particulate material. The purpose here is to agglomerate fine particles of material into larger particles. One application for such pellets is the pharmaceutical industry, in which the purpose is to agglomerate particles of almost dust-like fineness into pelletized particles which are easier to handle.

In a further application, namely coating, the intention is for the atomized liquid to form a surface coating on the material to be covered.

Nozzle assemblies such as those known, for example, from DE 41 10 127 A1 have proven advantageous in these applications. In that document, linear gap channels are provided. Gap-like discharge openings for a gaseous medium are provided on either side of a centered outlet channel for the liquid. By appropriate alignment of these gas streams it is possible to cause the liquid, after it has left the gap-like discharge opening, to be atomized into a mist, so that a long "wet" stream is not produced. In order to condition the atomized mist even further, provision is made in many applications for further gas outlet openings to be provided, through which, for example, a specially conditioned gas stream, for which the technical term "microclimate" has been established, is guided around the atomized mist. This microclimate ensures, for example, that the atomized mist does not dry prematurely or heat up or cool down in undesirable fashion (for example in hot-melt coating), but rather has the consistency required in the particular case when it encounters the material being treated.

A nozzle type that is also commonly used in this technology is known from DE 38 06 537 A1.

These nozzles are of annular construction and have a centered cylindrical channel with an outlet opening in the form of a circular surface for the liquid. This centered channel is surrounded by an annular channel through which the atomizing air is guided, which thus surrounds in annular fashion the centered cylindrical stream, thus resulting in a conical atomized mist.

It has been found in practical use that with specific operating variables and specific operating parameters for a specific application, satisfactory results can be achieved with a nozzle of a specific size.

Such specific operating variables are, for example, the gap width and gap length of the gaps through which the liquid and the gas streams emerge. The operating parameters (pressure and throughput volume) can be varied for a specific nozzle size.

A problem arises with "scaling-up," i.e. transitioning from an apparatus of a specific size, fitted with a specific number of nozzles of a specific size, to a larger size apparatus.

The procedure applied hitherto was to use in larger size apparatuses a greater number of nozzles of inherently identical design, which needs constructional efforts and, especially for the nozzles, several additional connections, i.e. supply hoses for supplying the greater number of nozzles with the respective media.

Attempts to operate a specific nozzle type with a higher output of, for example, liquid to be atomized—in order to be able to treat more particulate material in a larger apparatus—are unsuccessful if, for example, the throughput volume and the pressure of the liquid being passed through the nozzle become so great that that volume of fluid can no longer be atomized into a finely divided mist. In other words, at high pressures and high throughput volumes, long, "wet" tongues or flames occur, i.e. areas in which the liquid is still relatively compact and not atomized.

Consider the common use of such nozzles in a fluidized bed apparatus in whose base such nozzles are installed: the fluidized material floats in the vicinity of the discharge openings or just above them, so that long, "wet" flames or tongues cause the material being treated to be wetted in the vicinity of the nozzle, and uniform treatment over the entire fluidized bed cannot be achieved.

In scaling-up, therefore, nozzles of a specific physical size and a specific design are used in greater numbers in order correspondingly to achieve a higher throughput volume of liquid being atomized.

It is therefore the object of the present invention to provide assistance in this regard, and to allow, in the case of a nozzle type of the kind cited initially having concentric channels, a scaling-up procedure in which the number of nozzles does not need to be substantially increased, and in which a spray characteristic is obtained which is constant within certain bandwidths.

According to the present invention, the object is achieved in that the gap width of the discharge gap for atomizing the liquid at the discharge opening is in the range from 0.2 mm to 2.2 mm; that the gap width of the discharge gaps for passing out the gases at the discharge opening is in each case in the range from 0.3 mm to 2.3 mm; and that the ratio between the gap width of the discharge gap for atomizing the liquid and its circumferential gap length is in the range from 1:50 to 1:5000.

By adhering to these parameters it is possible to design nozzles of different sizes and thus different throughput volumes which nevertheless have the same spray characteristic. Given a nozzle in which the discharge opening for passage of the liquid being atomized has a specific diameter, the gap width can be varied in the range from 0.2 mm to 2.2 mm, with wider gaps allowing greater throughputs with a constant spray characteristic. If it is necessary, for example because material needs to be supplied to a larger apparatus, to deliver even more liquid per unit time through the nozzle, a larger-diameter nozzle can be made available, i.e. one with a greater gap length, but whose gap width is still in the range from 0.2 mm to 2.2 mm. The volume available for delivering the liquid is thereby correspondingly increased, but because of the predefined boundary conditions, the spray characteristic of the nozzle is retained. The "spray characteristic" means that even with a substantially larger nozzle at higher throughput volumes, the atomized mist conditions obtained are consistent with those of a substantially smaller nozzle, so that a material which is fluidized through this atomized mist area is thus acted upon just as uniformly, and with approximately the same quantity per unit volume or unit surface, by the liquid being atomized. This spray characteristic is retained in the range of ratios of gap width to gap length from 1:50 to 1:5000.

This recognition, based on intensive additional research, thus departs from the basic principle of providing multiple nozzles for large throughput volumes, and instead allows true scaling-up, i.e. makes it possible, when the apparatus is made larger, to treat larger volumes per unit time with the same or a slightly increased number of nozzles while retaining the spray characteristic.

Returning to the example in the pharmaceutical industry mentioned initially, which concerns the pelletizing of extremely finely powdered drugs: if optimum pelletizing results have been obtained for a specific batch size, for example in an apparatus having a capacity of 100 kg, with a specific number of nozzles and a specific nozzle size and thus a specific spray characteristic, it is thus easy to scale up to a treatment volume of 1000 kg in a correspondingly larger apparatus, since, while retaining the predefined parameters, the same spray characteristic and consequently also the same treatment results are retained even with a substantially larger nozzle.

The object is thus completely achieved.

In a further embodiment of the invention, the gap width of the discharge gap for atomizing the liquid lies in the range from 0.8 mm to 1.6 mm.

It has been found that with these gap widths the usual treatment methods, namely pelletizing, drying, and coating in the pharmaceutical industry in particular, can be performed on a scaled-up basis, and uniformly good treatment results can be obtained thereby, even with larger batches, using an approximately equal number of nozzles.

In a further embodiment of the invention, the gap width of the discharge gap for atomizing the liquid is approximately 1.2 mm.

It has been found in numerous investigations that this is an optimum gap width value allowing the liquids which are usual, for example, in the pharmaceutical industry to be atomized with a constant spray characteristic at various scaling-up ranges.

In a further embodiment of the invention, the gap width of the discharge gaps for emergence of the gas on either side of the gap for atomizing the liquid is in the range from 0.9 mm to 1.9 mm.

As previously mentioned, with the usual treatment methods this range allows scaling-up over a wide range with the usual treatment methods, while retaining a highly consistent spray characteristic.

In a particular embodiment of the invention, the gap width of the discharge gaps for emergence of the gas on either side of the gap for atomizing the liquid is approximately 1.3 mm.

In the previously cited fields of pelletizing, drying, and coating, in particular in the pharmaceutical industry, this gap width has proven to be an optimum value which allows very wide-range scaling-up while retaining outstanding spray characteristics.

In a further embodiment of the invention in which further concentric flow channels, which are arranged radially inside and/or radially outside the at least three concentric flow channels, are provided, the gap width of the discharge gap of those further concentric flow channels in the region of the discharge opening is in the range from 0.5 mm to 3.5 mm.

This selection range makes possible scaling-up with a consistent spray characteristic even with nozzles that are equipped with a conditioning "microclimate."

This retention of a very specific spray characteristic with a conditioning microclimate is achieved in particular with gap widths for the further concentric flow channels in the range from 2.0 to 3.0 mm, and in particular with gap widths of approximately 2.5 mm.

The more narrowly the bandwidths are stated, and the more specifically the operating parameters (for example the pressure at which the media are passed through the channels) are specified, the easier it is to scale up under the conditions stated.

This has the advantage not only that, in contrast to the existing art cited initially, scaling-up now does not involve directing numerous additional connections to the numerous additional nozzles, but also that substantially the same number of nozzles or, if applicable due to geometrical requirements, a slightly greater number of nozzles, needs to be used. In addition, the often difficult and (in particular) tiresome investigations and experiments involved in a scaling-up operation become superfluous. The data obtained previously, which were discovered at a very specific batch size, a specific nozzle size, and with specific operating parameters, hitherto needed to be determined all over again when scaling-up in order once again to achieve the same coating results with a larger batch as with the smaller batch. This is now substantially simplified.

The invention is independent of whether the flow channels are strictly annular, oval, or elliptical, or whether they are continuously annular or spray out only through subsections; it is also independent of whether the spray direction runs exactly along the flow channel axis or is directed radially out of it. The reason is that it has been ascertained by intensive investigations that even with differing designs as will be described below, consistently good scaled-up treatment results can be obtained if the gap width and gap length parameters are observed.

It is understood that the features mentioned above and those yet to be explained below can be used not only in the respective combinations indicated, but also in other combinations or in isolation, without leaving the context of the present invention.

The invention will be described in more detail and explained below with reference to a few selected exemplifying embodiments in conjunction with the appended drawings, in which:

in FIG. 3 as well, an area bordered by a circle is shown at larger scale for explanatory purposes;

Figure 1:
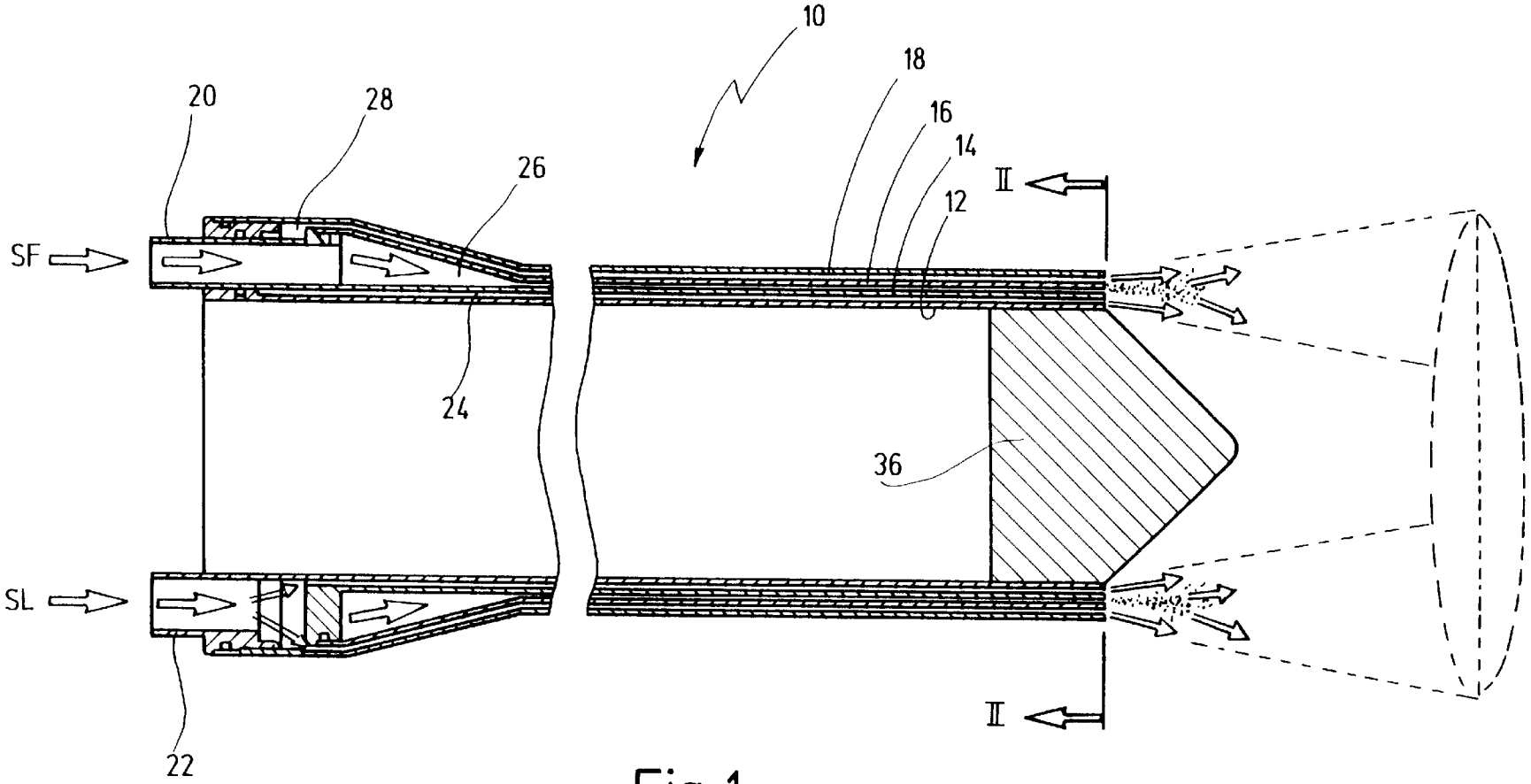
FIG. 1 shows a longitudinal section of a first embodiment of a multi-substance diffusing nozzle according to the invention, having a total of three concentric flow channels.
Figure 2:
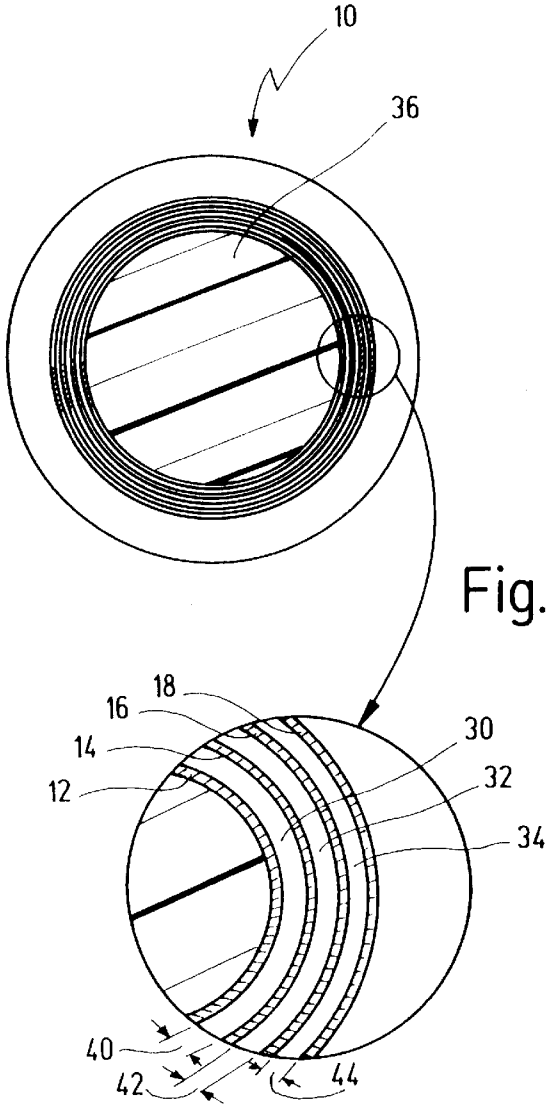
FIG. 2 shows a section along line II—II in FIG. 1 in the area of the discharge opening, an area bordered by a circle in FIG. 1 being additionally depicted at greatly enlarged scale.

A multi-substance diffusing nozzle shown in FIGS. 1 and 2 is assigned, in its totality, the reference symbol 10.

Nozzle 10 comprises four tubes 12, 14, 16, and 18 inserted coaxially into one another.

The two outer tubes 16 and 18 are equipped at the inflow end with radial expansions, thus correspondingly forming the incident flow chambers (not labeled in detail) which are supplied via connector fittings 20 and 22 with the media to be atomized by nozzle 10.

Constituted between innermost tube 12 and the radially adjacent outer tube 14 is a channel 24 which, as is clearly evident from the enlarged partial depiction of FIG. 2, terminates in an annular discharge gap 30 in the region of the discharge opening of nozzle 10.

A further channel 26 which terminates in an annular discharge gap 32 is created between tube 14 and the next radially outward tube 16, as is evident from FIG. 2.

A further channel 28, which terminates in an annular discharge gap 34 in the region of the discharge opening, is created between tube 16 and outermost tube 18.

Inner channel 24 and outer channel 28 are supplied via connector fitting 22 with a gas medium, called the "atomizing air" SL, which is evident in particular from the sectioned depiction of FIG. 1.

Middle channel 26 is supplied via connector fitting 20 with liquid SF to be atomized.

When the two media, atomizing air SL and atomized liquid SF, are then delivered through nozzle 10, the liquid emerges through discharge gap 32 and is atomized into a fine mist by the atomizing air emerging on either side through discharge gaps 30 and 34, as indicated in FIG. 1 by the arrows.

Innermost tube 12 is closed off by a closure plug 36, the overall result being an annular atomized cone as indicated in FIG. 1 by the dashed lines. This atomized cone has a very specific characteristic, i.e. the finely atomized liquid particles move away from the nozzle opening with a specific characteristic, i.e. in a specific direction and with a specific spatial density distribution.

If a greater volume of liquid now needs to be delivered through a nozzle 10, it is not possible to deliver the atomized liquid through channel 26 at an arbitrarily higher pressure and thus at a higher throughput, since then a relatively long, "wet" tongue or flame of emerging atomized liquid SF is created before it can be atomized (if at all) by the atomizing air into a mist. Since a "wet" tongue of this kind can attain a length of several centimeters, but the material to be treated is already present within centimeters in front of the nozzle opening, a uniform treatment result would no longer be achieved, and certainly not with the desired spray characteristic.

Figure 3:
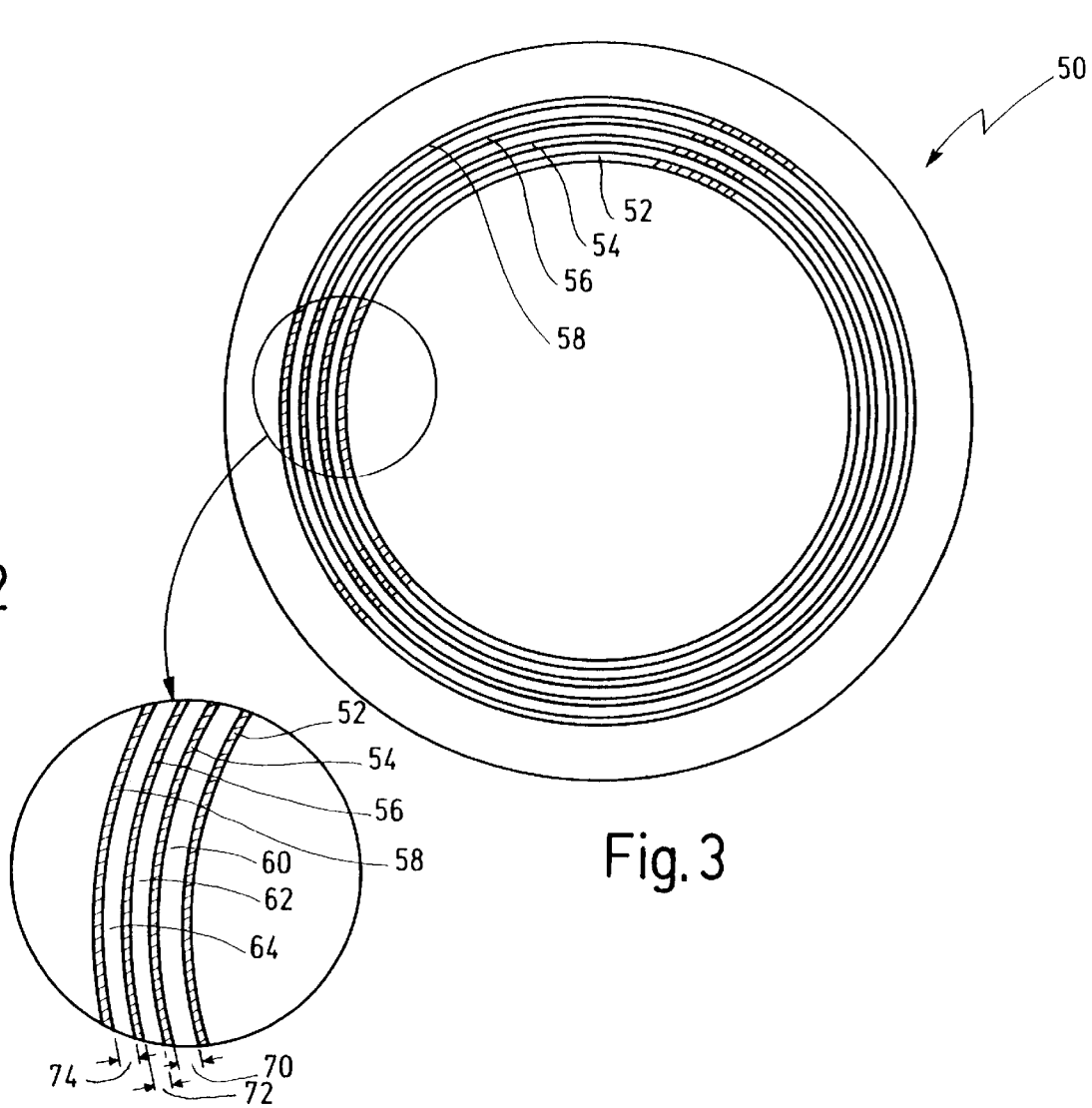
FIG. 3 shows a section, comparable to that of FIG. 2, of a larger nozzle having the same spray characteristic as the nozzle shown in FIGS. 1 and 2.

FIG. 3 thus depicts a nozzle 50 which is also constructed from four tubes 52, 54, 56, and 58 inserted into one another, so that corresponding discharge gaps 60, 62, and 64 result at the opening of nozzle 50. The diameter and materials of tubes 52, 54, 56, and 58 are selected so that gap width 72 of discharge gap 62 through which the liquid emerges corresponds approximately to gap width 42 of opening gap 32 of nozzle 10. Similarly, gap widths 70 and 74 of discharge gaps 60 and 64 of nozzle 50 are approximately equal to gap widths 40 and 44 of discharge gaps 30 and 34 of nozzle 10, i.e. of the regions through which the atomizing air emerges.

It is apparent from the enlarged bordered areas of FIGS. 2 and 3 that under identical operating conditions an identical spray characteristic, i.e. a corresponding distribution of the atomized particles, can be achieved irrespective of whether delivery occurs through nozzle 2 or nozzle 3. Because the circumference of discharge gaps 60, 62, and 64 is substantially greater, however, in overall terms a substantially higher volume of atomized liquid SF and atomizing air SL can be delivered through nozzle 50 per unit time, so that on a scaled-up basis, more material can be atomized with a nozzle 50 while the spray characteristic remains the same.

There is no change not only in the microscopically considered spray characteristic but also in the macroscopic spray characteristic (except that nozzle 50 has a greater diameter), as long as the dimensioning rules—a ratio between gap width 42 or 72 and circumferential gap length of between 1:50 and 1:5000 —are observed.

Figure 4:
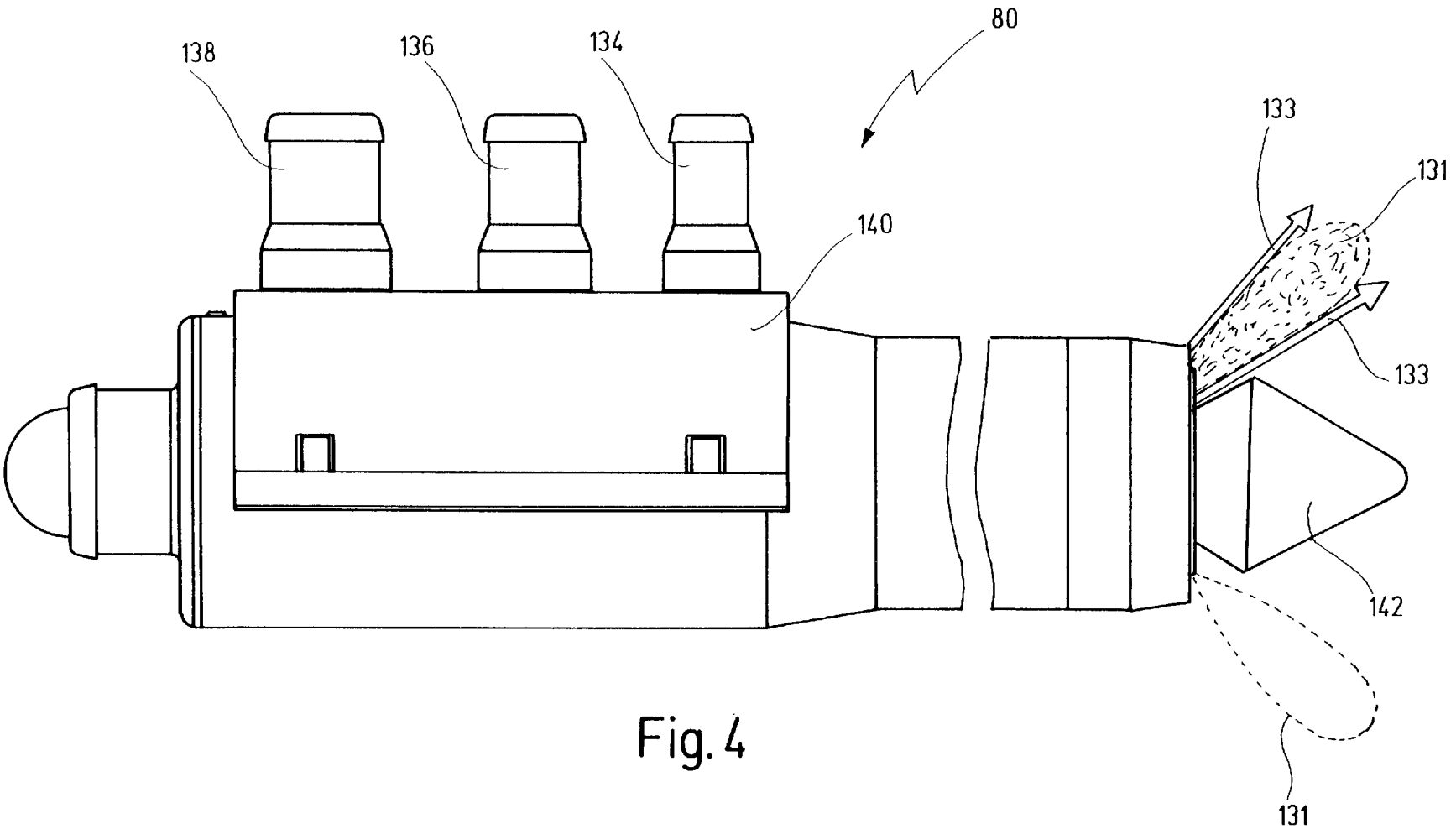
FIG. 4 shows a schematic side view of a further embodiment of a multi-substance diffusing nozzle having five flow channels and a spray direction directed laterally out of the center longitudinal axis of the nozzle.
Figure 5:
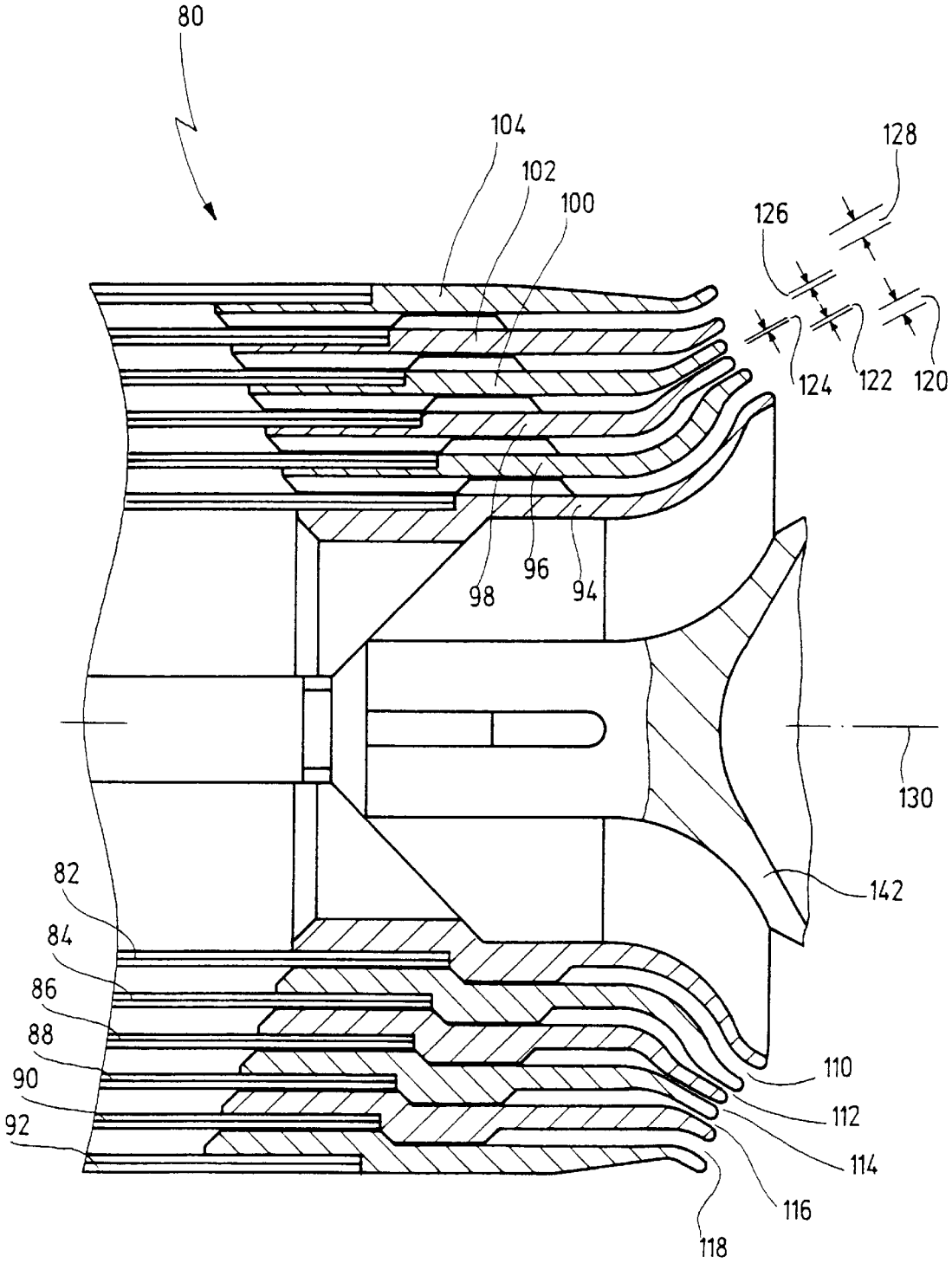
FIG. 5 shows a greatly enlarged longitudinal section of the discharge opening area of the nozzle shown in FIG. 4.

FIGS. 4 and 5 depict a further embodiment of a nozzle 80 that is made up of six tubes 82, 84, 86, 88, 90, and 92 inserted into one another. In the region of the discharge end, six shaped rings 94, 96, 98, 100, 102, and 104, which ensure that the channels created between the tubes in the region of the discharge opening are deflected out of longitudinal center axis 130 of nozzle 80, are slid onto tubes 82, 84, 86, 88, 90, and 92.

Annular discharge gaps 110, 112, 114, 116, and 118 are present in the case of nozzle 80 as well, however.

Discharge gap 114 which is created between ring 98 and 100 has a gap width 124; the liquid is atomized through this gap.

Present on either side of discharge gap 114 are two annular discharge gaps 112, 116 which are configured between rings 100, 102 and 96, 98 and whose gap widths 122 and 126 are identical to and somewhat greater than gap width 124.

The atomizing air emerging through discharge gaps 112 and 116 diffuses the liquid emerging through discharge gap 114 into a fine atomized mist 131 which is indicated in FIG. 4 and is directed laterally out of longitudinal center axis 130.

A gaseous medium which provides for a so-called microclimate 133, which is present around atomized mist 131 and conditions the latter accordingly as indicated by the arrows in FIG. 4, is passed through innermost discharge gap 110 and outermost discharge gap 118 between rings 94 and 96 and rings 102 and 104. Microclimate 133 ensures, for example, that the media of atomized mist 131 do not cool off too rapidly, i.e. their temperature is maintained by the microclimate.

It is evident from FIG. 5 that gap widths 128 and 120 of discharge gaps 110 and 118 are somewhat greater than the gap widths of the other discharge gaps.

For example, gap width 124 is approximately 1.2 mm, gap widths 122 and 126 are approximately 1.3 mm, and gap widths 120 and 128 are approximately 2.5 mm.

The circumferential gap length of gap 114 through which the atomized liquid emerges is approximately 408 mm, so that the ratio between gap width 124 and the gap length is in the vicinity of 1:340.

If a scaling-up then needs to be performed, tubes of larger diameter but with approximately constant radial spacings are used, so that then once again the spray characteristic is retained.

In contrast to nozzle 110, closure plug 142 does not completely close off the inner channel surrounded by inner tube 82, so that a medium, for example process air or a mixture of process air and a solid that is additionally to be atomized via nozzle 80, can also pass through the interior of nozzle 80.

I claim:

1. A multi-substance diffusing nozzle having at least three concentric flow channels, each of said three channels leading to an opening, each opening being designed as a discharge gap, a discharge gap for atomizing a liquid being surrounded on either side by a discharge gap for passing out of a gas, wherein a gap width of said discharge gap for atomizing the liquid at said discharge opening is in the range from 0.2 mm to 2.2 mm;

a gap width of said discharge gaps for passing out of said gases at said discharge opening is in each case in the range from 0.3 mm to 2.3 mm; and a ratio between said gap width of the discharge gap for atomizing the liquid and a circumferential gap length thereof is in a range from 1:50 to 1:5000.

2. The multi-substance diffusing nozzle of claim 1, wherein said gap width of said discharge gap for atomizing the liquid is in the range from 0.8 mm to 1.6 mm.

3. The multi-substance diffusing nozzle of claim 1, wherein said gap width of said discharge gap for atomizing the liquid is approximately 1.2 mm.

4. The multi-substance diffusing nozzle of claim 1, wherein said gap width of said discharge gaps for passing out of said gas on either side of said gap for atomizing the liquid is in the range from 0.9 mm to 1.9 mm.

5. The multi-substance diffusing nozzle of claim 1, wherein the gap width of said discharge gaps for passing out of said gas on either side of said gap for atomizing the liquid is approximately 1.3 mm.

6. The multi-substance diffusing nozzle of claim 1, wherein further concentric flow channels beside said three concentric flow channels are provided, which further concentric flow channels are arranged radially inside said at least three concentric flow channels, a gap width of a discharge gap of those further concentric flow channels at said discharge opening are in the range from 0.5 mm to 3.5 mm.

7. The multi-substance diffusing nozzle of claim 6, wherein said gap width of said further concentric flow channels is in the range from 2.0 to 3.0 mm.

8. The multi-substance diffusing nozzle of claim 7, wherein said gap width of said further concentric flow channels is approximately 2.5 mm.

9. The multi-substance diffusing nozzle of claim 1, wherein further concentric flow channels beside said three concentric flow channels are provided, which further concentric flow channels are arranged radially outside said three concentric flow channels, a gap width of a discharge gap of those further concentric flow channels at said discharge opening are in the range from 0.5 mm to 3.5 mm.

10. The multi-substance diffusing nozzle of claim 9, wherein said gap width of said further concentric flow channels is in the range from 2.0 to 3.0 mm.

11. The multi-substance diffusing nozzle of claim 10, wherein said gap width of said further concentric flow channels is approximately 2.5 mm.

12. The multi-substance diffusing nozzle of claim 1, wherein further concentric flow channels beside said three concentric flow channels are provided, which further concentric flow channels are arranged radially inside and radially outside said three concentric flow channels, a gap width of a discharge gap of those further concentric flow channels at said discharge opening are in the range from 0.5 mm to 3.5 mm.

13. The multi-substance diffusing nozzle of claim 12, wherein said gap width of said further concentric flow channels is in the range from 2.0 to 3.0 mm.

14. The multi-substance diffusing nozzle of claim 13, wherein said gap width of said further concentric flow channels is approximately 2.5 mm.

* * * * *